US009528214B2

(12) United States Patent
Buyuktopcu

(10) Patent No.: US 9,528,214 B2
(45) Date of Patent: Dec. 27, 2016

(54) HOUSEHOLD APPLIANCE WITH CONTROLLED AMOUNT OF ENERGY CONSUMPTION

(75) Inventor: Cagatay Buyuktopcu, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 0 days.

(21) Appl. No.: 13/129,967

(22) PCT Filed: Nov. 12, 2009

(86) PCT No.: PCT/EP2009/065047

§ 371 (c)(1),
(2), (4) Date: Aug. 8, 2011

(87) PCT Pub. No.: WO2010/057827

PCT Pub. Date: May 27, 2010

(65) Prior Publication Data

US 2011/0283216 A1 Nov. 17, 2011

(30) Foreign Application Priority Data

Nov. 18, 2008 (TR) ..... a 2008 08765

(51) Int. Cl.

| | |
|---|---|
| ***G06F 3/048*** | (2013.01) |
| ***D06F 39/00*** | (2006.01) |
| ***A47L 15/42*** | (2006.01) |
| ***F24C 7/08*** | (2006.01) |

(52) U.S. Cl.
CPC ..... *D06F 39/005* (2013.01); *A47L 15/4293* (2013.01); *F24C 7/085* (2013.01)

(58) Field of Classification Search
CPC ..... G06F 1/26; G06F 3/048; G01R 21/133
USPC ..... 715/771
See application file for complete search history.

(56) References Cited

U.S. PATENT DOCUMENTS

| | | | | |
|---|---|---|---|---|
| 4,884,054 | A * | 11/1989 | Moon, Sr. | 340/457.4 |
| 7,831,321 | B2 * | 11/2010 | Ebrom et al. | 700/87 |
| 2004/0098171 | A1 * | 5/2004 | Horst | 700/295 |
| 2009/0077399 | A1 * | 3/2009 | Noda et al. | 713/320 |

FOREIGN PATENT DOCUMENTS

| | | | |
|---|---|---|---|
| DE | 3932170 | A1 | 4/1991 |
| DE | 19650914 | A | 1/1998 |
| EP | 0596302 | A | 5/1994 |
| EP | 596302 | A1 * | 5/1994 |
| JP | 2006023813 | A * | 1/2006 |
| WO | 2004056255 | A1 | 7/2004 |

* cited by examiner

*Primary Examiner* — Jennifer To
*Assistant Examiner* — Xuyang Xia
(74) *Attorney, Agent, or Firm* — Kilpatrick Townsend & Stockton LLP

(57) ABSTRACT

The present invention relates to a household appliance (1) comprising a control unit (5) that determines the program parameters according to the target amount of energy consumption ($E_t$) determined by the user and thus, provides the program to be executed.

2 Claims, 1 Drawing Sheet

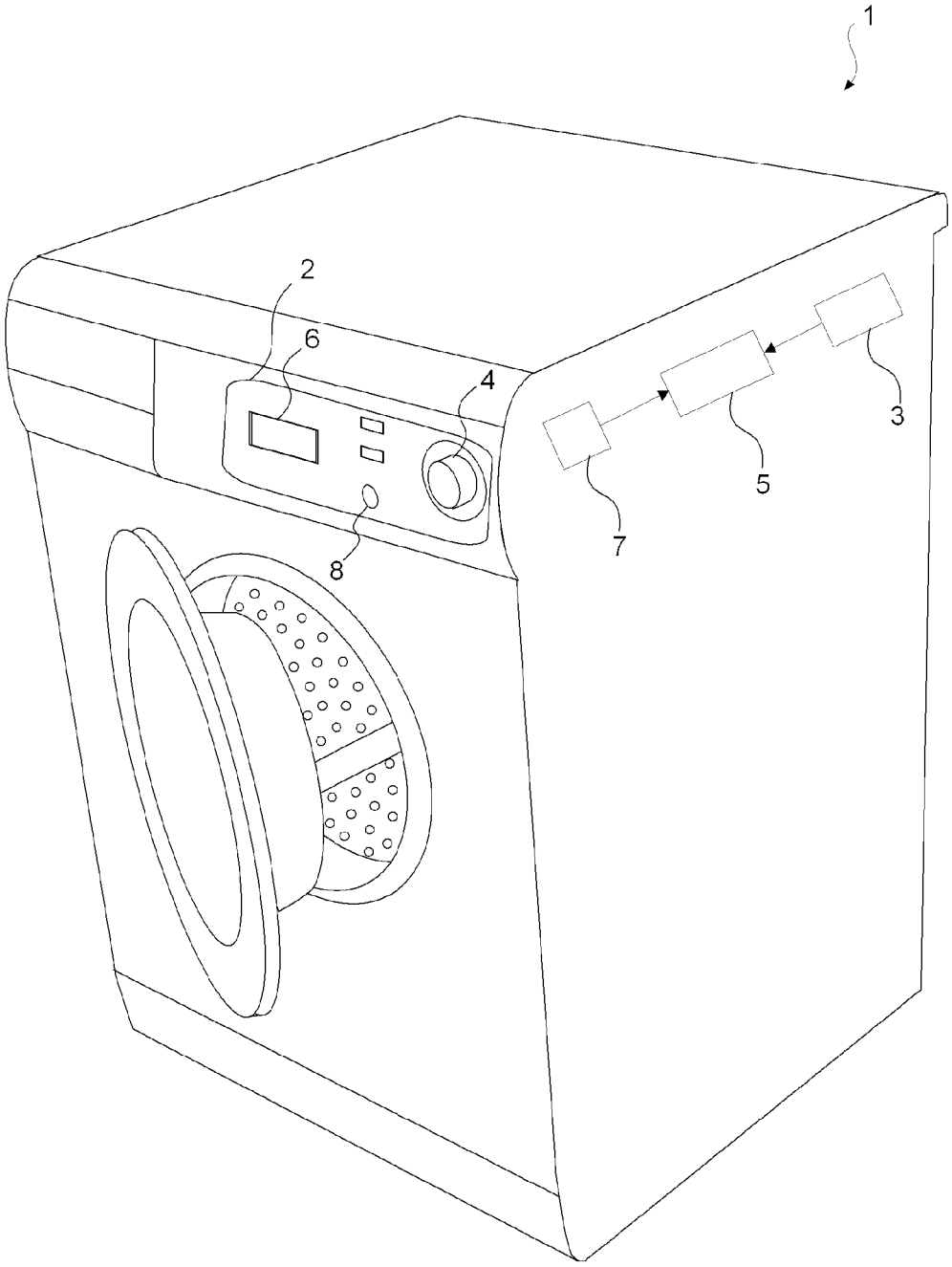
1
2
6
4
3
5
7
8

HOUSEHOLD APPLIANCE WITH CONTROLLED AMOUNT OF ENERGY CONSUMPTION

The present invention relates to a household appliance wherein the amount of energy consumption of the program to be performed can be determined by the user.

The diminishing energy resources, the growing population and the amount of energy per capita on the earth necessitate the efficient use of the limited energy resources. By this need, various embodiments are developed in order to inform the user about energy consumption and to encourage the user to save energy during usage of household appliances. By designing household appliances wherein energy saving is realized by the initiative of the user, energy costs are tried to be reduced.

In the state of the art Japanese Patent Application No JP2006023813, an embodiment is described wherein the amount of energy consumption is measured by a measuring circuit and is displayed by an LCD display on the panel.

In the state of the art German Patent Documents No DE19650914 and DE3932170 and International Patent Application No WO2004056255, household appliances are described wherein estimated or actual amounts of energy consumption are displayed to the user according to the selected program in order to encourage the user to save energy.

The aim of the present invention is the realization of a household appliance wherein the user is provided to control the energy consumption.

The household appliance realized in order to attain the aim of the present invention is explicated in the claims.

The household appliance of the present invention comprises a measuring circuit calculating the amount of consumed energy during its operation. The user enters the target amount of energy consumption he/she desires the household appliance to consume by means of the selection means at the beginning of the program. The household appliance comprises a control unit which determines the program parameters according to the target amount of energy consumption and thus, provides the program to be performed without exceeding the target amount of energy consumption.

In an embodiment of the present invention, on the user interface, the household appliance comprises an energy saving button which is switched to the active position to enter the target amount of energy consumption and a display whereon the target amount of energy consumption that is entered by means of the selection means is displayed.

In another embodiment of the present invention, by the user switching the energy saving button to the active position, the minimum amount of energy consumption required for any program to be performed that is predetermined by the producer is displayed on the display. By the user switching the energy saving button to the active position to enter the target amount of energy consumption, the target amount of energy consumption can be determined by means of the selection means such that it will be greater than the minimum amount of energy consumption appearing on the display. The control unit determines the optimum program parameters such that they will not exceed the target amount of energy consumption entered by the user and provides the program to be performed accordingly. Thus, the user is informed about the minimum amount of energy the household appliance will use in order to execute the program and accordingly the user is encouraged to use the household appliance such that it will consume minimal energy.

In another embodiment of the present invention, by the user switching the energy saving button to the active position, the display changes to the active position; however, no value is displayed to the user. The user performs the entering of the target amount of energy consumption by means of the selection means. In this embodiment wherein no reference value is presented to the user, the control unit provides the program to be performed such that it will prevent the going out of range of the minimum and maximum amounts of energy consumption predetermined by the producer.

In another embodiment of the present invention, the household appliance comprises a memory wherein the data of the minimum amount of energy consumption and the standard amount of energy consumption are stored which belong to the programs having different program parameters that are predetermined by the producer. After making the program selection, the user switches the energy saving button to the active position and thus, passes to the mode wherein he/she will determine the target amount of energy consumption and views the standard amount of energy consumption that belongs to the selected program on the display. The user enters the desired target amount of energy consumption by means of the selection means such that it will be greater than the minimum amount of energy. The control unit revises the selected program parameters according to the target amount of energy consumption and thus, provides the program to be performed. Thus, the data of standard amounts of energy consumption, wherein different programs selected by the user can be executed, are presented to the user and thus, the user is provided with the opportunity to execute the desired program by consuming energy as minimal as possible.

In an embodiment of the present invention, the selection means is a keypad whereon numbers are situated. Thus, the user can easily enter the target amount of energy consumption numerically.

In an embodiment of the present invention, the selection means is shaped as a rotary button that serves to enter value by being rotated.

In another embodiment of the present invention, beginning from the program start until the program is completed, the amount of energy the household appliance will consume according to the target amount of energy consumption is displayed on the display. Thus, the user is provided to be informed about the consumed part of the target amount of energy consumption throughout the program and about the amount of energy required to be consumed until the end of the program.

In another embodiment of the present invention, the amount of energy that will be consumed during the program until the program is completed and the remaining time for the program to be completed are displayed in alternating sequence. Thus, at any moment during the program, the user is provided to be informed about the amount of energy that will be consumed for the program to be completed and about the remaining time.

The household appliance of the present invention can be a washing machine, a dishwasher, a dryer or an oven.

The household appliance realized in order to attain the aim of the present invention is illustrated in the attached figures, where:

FIG. 1—is the schematic view of a household appliance.

The elements illustrated in the figures are numbered as follows:

1. Household appliance
2. User interface
3. Measuring circuit

4. Selection means
5. Control unit
6. Display
7. Memory
8. Energy saving button Following symbols are used to explain the household appliance (1) of the present invention:

$E_t$: The target amount of energy consumption entered by the user $E_m$: The minimum amount of energy consumption required for the program to be executed that is predetermined by the producer $E_s$: The standard amount of energy consumption which has different values for different program options having different parameters that are predetermined by the producer For the determination of the $E_m$ and $E_s$ values, the household appliance (1) is operated in the laboratory environment by the producer, the energy consumption values are calculated and averages of these values are used.

The household appliance (1) of the present invention comprises a user interface (2), a measuring circuit (3) that calculates the amount of consumed energy, a control unit (5) that evaluates the commands transmitted through the user interface (2) and accordingly provides the program to be performed, a display (6) and at least one selection means (4) that provides the user to enter the target amount of energy consumption ($E_t$) he/she desires the household appliance (1) to consume throughout the program. The control unit (5) determines the program parameters according to the target amount of energy consumption ($E_t$) entered by means of the selection means (4) and thus, provides the program to be executed without the target amount of energy consumption ($E_t$) being exceeded.

The amount of energy the household appliance (1) will consume while executing any program is determined by the user entering the target amount of energy consumption ($E_t$) by means of the selection means (4). The target amount of energy consumption ($E_t$) entered by means of the selection means (4) is transmitted to the control unit (5) and the control unit (5) provides the household appliance (1) to execute the program such that it will consume energy as much as the entered target amount of energy consumption ($E_t$). Thus, the amount of energy the household appliance (1) will consume during its operation is determined by the initiative of the user, and the user is intended to become conscious about the amount of consumed energy and hence to be encouraged to consume less energy.

In an embodiment of the present invention, the household appliance (1) comprises an energy saving button (8) which has two different positions being active and passive, and which is switched to the active position to enter the target amount of energy consumption ($E_t$), and a display (6) whereon the target amount of energy consumption ($E_t$) that is entered by means of the selection means (4) by the energy saving button (8) being switched to the active position is displayed. When the user desires to execute a program according to the target amount of energy consumption ($E_t$), he/she switches the energy saving button (8) to the active position and brings the selection means (4), by which he/she can enter the target amount of energy consumption ($E_t$), to the active position. Thus, ease of entering the target amount of energy consumption ($E_t$) is provided to the user.

In an embodiment of the present invention, on the display (6), the minimum amount of energy consumption required for the program to be executed is displayed. The minimum amount of energy consumption ($E_m$) is the lowest amount of energy consumption which is predetermined by the producer and which the household appliance (1) requires to consume in order to perform any program. For example, in the situation that the household appliance (1) is a washing machine, the minimum amount of energy consumption ($E_m$) corresponds to the amount of energy the household appliance (1) consumes throughout a program wherein it takes water and detergent, and after rotating for a while, performs rinsing and spin-drying and completes the washing process. The user triggers the selection means (4) and enters the target amount of energy consumption ($E_t$) such that it will not be smaller than the minimum amount of energy consumption ($E_m$) displayed on the display (6). In this situation, the control unit (5) determines the program parameters such that they will not exceed the target amount of energy consumption ($E_t$), and provides the program to be performed accordingly. For example, in the situation that the household appliance (1) is a washing machine, the control unit (5) determines the program parameters such as whether the water will be heated, the temperature of the water if it will be heated, the amount of water that will be used in washing, washing time, number of rinsing cycles, rinsing time, number of spin-drying cycles, spin-drying speed and spin-drying time according to the target amount of energy consumption ($E_t$). The control unit (5) optimizes the program parameters, provided that they will not exceed the target amount of energy consumption ($E_t$), and creates a new program profile. The program profile is determined by the control unit (5) by an optimization being performed such that it will comprise all washing steps such as washing, rinsing, spin-drying and drying. Thus, while the user is provided with the opportunity to execute a program that is completed with the desired amount of energy, at the same time, the user is encouraged to consume energy as minimal as possible and so, energy saving is provided.

In an embodiment of the present invention no value is displayed on the display (6). In this situation, the user enters any desired value as the target amount of energy consumption ($E_t$) by means of the selection means (4). If the target amount of energy consumption ($E_t$) entered by means of the selection means (4) is smaller than the minimum amount of energy consumption, the control unit (5) updates the target amount of energy consumption ($E_t$) such that it will be equal to the minimum amount of energy ($E_m$). Similarly, if the target amount of energy consumption ($E_t$) entered by the user is greater than the maximum amount of energy that is determined by the producer and that can be consumed for the program to be executed, the control unit (5) updates the target amount of energy consumption ($E_t$) such that it will be equal the target amount of energy consumption ($E_t$) to the maximum amount of energy. Thus, a target amount of energy consumption ($E_t$) that is insufficient for or greater than required to execute the program is prevented from being determined. The control unit (5) determines the program parameters such that they will not exceed the target amount of energy consumption ($E_t$) entered by the user, and provides the program to be performed accordingly. For example, if the household appliance (1) is a washing machine, the control unit (5) determines the program parameters such as whether the water will be heated, the temperature of the water if it will be heated, the amount of water that will be used in washing, washing time, number of rinsing cycles, rinsing time, number of spin-drying cycles, spin-drying speed and spin-drying time according to the target amount of energy consumption ($E_t$). The control unit (5) optimizes the program parameters, provided that the target amount of energy consumption ($E_t$) will not be exceeded, and creates a new program profile. The program profile is determined by the control unit (5) by an optimization being performed such that it will comprise all washing steps such as washing, rinsing, spin-drying and drying. Thus, while the user is provided with the opportunity to execute a program that is completed with the desired amount of energy, at the same time, the user is encouraged to consume energy as minimal as possible and so, energy saving is provided.

In another embodiment of the present invention, the household appliance (1) comprises a memory (7) wherein the minimum amounts of energy consumption ($E_m$) and the standard amounts of energy consumption ($E_s$) are saved, which belong to different program options having program parameters that are predetermined by the producer. For example, if the household appliance (1) is a washing machine, the minimum amounts of energy consumption ($E_m$) and the standard amounts of energy consumption ($E_s$), which belong to more than one program predetermined according to parameters such as the type of laundry, water temperature, washing time, spin-drying speed and additional functions, are saved in the memory (7). When the user performs a certain program selection and switches the energy saving button (8) to the active position in order to execute the program according to the target amount of energy consumption ($E_t$), the standard amount of energy ($E_s$) belonging to this program is displayed on the display (6). The user determines the target amount of energy consumption ($E_t$) such that it will not be smaller than the minimum amount of energy ($E_m$) and performs the entering thereof by means of the selection means (4). The control unit (5) determines the program parameters according to the target amount of energy consumption ($E_t$) independently of the program parameters the user determined at the beginning of the program, and provides the program to be performed. For example, in the embodiment wherein the household appliance (1) is a washing machine, let us suppose that the standard amount of energy consumption ($E_s$) displayed on the display (6) is 1.4 kW when the user selects the synthetic program and the program parameters such that the water temperature will be 40 degrees and the spin-drying speed will be 1000 rpm in order to wash his/her synthetic laundry, and switches the energy saving button (8) to the active position. When the user performs an entering by means of the selection means (4) such that the target amount of energy consumption ($E_t$) will be 1.0 kW, the control unit (5) rearranges the program parameters, the entering of which the user has performed at the beginning of the program, according to the entered target amount of energy consumption ($E_t$), and creates a new program profile. For example, the washing temperature will be reduced to 35 degrees and the spin-drying speed will be determined as 800 rpm. Thus, the user is provided with the opportunity to execute the desired program by consuming the desired amount of energy. Furthermore, the user is encouraged to execute the different program options the household appliance (1) performs with an amount of energy as minimal as possible and thus, energy saving is provided.

In another embodiment of the present invention, the selection means (4) is shaped as a keypad whereon numbers are situated such that it will provide the entering of the target amount of energy consumption ($E_t$). Thus, the user easily enters the desired target amount of energy consumption ($E_t$) numerically.

In another embodiment of the present invention, the selection means (4) is shaped as a rotary button which provides increasing and decreasing the numerical value displayed on the display (6) by being rotated clockwise or counterclockwise and thus, which enables the target amount of energy consumption ($E_t$) to be entered.

In another embodiment of the present invention, the selection means (4) is a button consisting of two keys, one of which provides the standard value of energy consumption ($E_s$) displayed on the display (6) to increase numerically when triggered and the other provides it to decrease when triggered.

In another embodiment of the present invention, when the selection is performed by the selection means (4) and the program is executed according to the target amount of energy consumption ($E_t$), the amount of energy yet to be consumed until the program is completed is displayed on the display (6). Thus, the user is provided to be informed about the amounts of energy consumption of the program phases.

In another embodiment of the present invention, when the target amount of energy consumption ($E_t$) is entered by the selection means (4) and the program is executed, the data of how much energy is left from the target amount of energy consumption ($E_t$) and how much time is left for the program to be completed are displayed to the user in alternating sequence. Thus, the user is informed at any moment about the energy the program will consume until the program is completed and about the program time.

The household appliance (1) of the present invention can be a washing machine, a dishwasher, a dryer or an oven.

By means of the household appliance (1) of the present invention, the performed process/program is executed by being stuck to the target amount of energy consumption ($E_t$) determined by the user. Thus, the user is provided with the opportunity to consume energy as minimal as possible and so, energy saving is provided.

It is to be understood that the present invention is not limited by the embodiments disclosed above and a person skilled in the art can easily introduce different embodiments. These should be considered within the scope of the protection postulated by the claims of the present invention.

The invention claimed is:

1. A household appliance comprising:

a user interface;

a measuring circuit that calculates an amount of consumed energy;

a display;

at least one keypad or rotary button;

a control unit that evaluates commands transmitted through the user interface by a user selecting the at least one keypad or rotary button on the display; and a memory that stores a minimum amount of energy consumption, a maximum amount of energy consumption and a standard amount of energy consumption, which belong to different program options having program parameters that are predetermined by a producer, the control unit coupled to the memory, cause the control unit to perform a program comprising:

entering by the user at the beginning of the program a target amount of energy consumption desired for the household appliance to consume throughout the program;

determining the program parameters according to the target amount of energy consumption, without the target amount of energy consumption being exceeded throughout the program, wherein if the target amount of energy consumption is smaller than the minimum amount of energy consumption, the control unit updates the target amount of energy consumption to be equal to the minimum amount of energy consumption, if the target amount of energy consumption is greater than the maximum amount of energy consumption, the control unit updates the target amount of energy consumption to equal the target amount of energy consumption to the maximum amount of energy consumption;

displaying the minimum amount of energy consumption, which is predetermined by the producer and which is required for any program to be performed, at the beginning of the program;

receiving data from the memory by the user selecting the program to perform and which provides the standard amount of energy consumption belonging to the program to be displayed on the display;

displaying an amount of energy to be consumed that is left from the target amount of energy consumption until the program is completed at any moment during the operation of the program; and displaying the target amount of energy consumption of the ongoing program, an amount of energy that will be consumed until the program is completed and a remaining time for the program to be completed in alternating sequence.

2. The household appliance of claim 1, wherein the household appliance is selected from the group consisting of a washing machine, a dryer, a dishwasher and an oven.

* * * * *